US009977444B1

(12) United States Patent
Kong et al.

(10) Patent No.: US 9,977,444 B1
(45) Date of Patent: May 22, 2018

(54) POWER MANAGEMENT SYSTEM AND METHOD OF THE SAME

(71) Applicant: Beken Corporation, Shanghai (CN)

(72) Inventors: Ronghui Kong, Shanghai (CN); Jiazhou Liu, Shanghai (CN)

(73) Assignee: BEKEN CORPORATION, Shanghai (CN)

( * ) Notice: Subject to any disclaimer, the term of this patent is extended or adjusted under 35 U.S.C. 154(b) by 0 days. days.

(21) Appl. No.: 15/437,095

(22) Filed: Feb. 20, 2017

(51) Int. Cl.
*G05F 1/563* (2006.01)
*G05F 1/46* (2006.01)
*G05F 1/575* (2006.01)

(52) U.S. Cl.
CPC ..... *G05F 1/563* (2013.01); *G05F 1/461* (2013.01); *G05F 1/468* (2013.01); *G05F 1/575* (2013.01)

(58) Field of Classification Search
CPC ..... G05F 1/461; G05F 1/468; G05F 1/563; G05F 1/575; G05F 1/59
See application file for complete search history.

(56) References Cited

U.S. PATENT DOCUMENTS 6,281,667 B1 * 8/2001 Matsumura ..... G05F 1/565 323/274
8,143,872 B2 * 3/2012 Lipcsei ..... G05F 1/56 323/282
9,152,158 B2 * 10/2015 Dobkin ..... G05F 1/468
9,417,646 B2 * 8/2016 Yasusaka ..... G05F 1/575

* cited by examiner

*Primary Examiner* — Kyle J Moody
(74) *Attorney, Agent, or Firm* — Perkins Coie LLP

(57) ABSTRACT

A power management system comprises an input power detector configured to generate a first enablement signal by detecting whether a first voltage is supplied; a first output stage connected to the input power detector and configured to receive and regulate the first voltage upon receiving the first enablement signal; an error operational amplifier is connected to the first output stage, a first input port of the error operational amplifier is configured to receive a first reference voltage, a second input port of the error operational amplifier is connected to a connection point of a first resistor and a second resistor, the first resistor is connected to the first output stage, the second resistor is connected to ground, and a system output port is located at the connection of the output port of the first output stage and the first resistor, to drive a load.

13 Claims, 10 Drawing Sheets

POWER MANAGEMENT SYSTEM AND METHOD OF THE SAME

CLAIM OF PRIORITY

This application claims priority to Chinese Application number 201710058795.5 entitled "power management system and method of the same," filed on Jan. 23, 2017 by Beken Corporation, which is incorporated herein by reference.

TECHNICAL FIELD

The present application relates to circuit chip application and more particularly, but not exclusively, to power management system and method of the same.

BACKGROUND

In modern chip applications, a circuit often has two or more power supply inputs, and a chip for the circuit can work under any of the power inputs. For example, under normal circumstances, the chip is powered by a lithium battery. When the lithium battery runs out of power and is charged via a USB port, the chip will work under the USB power, which requires the chip to switch between two power supplies. Therefore, it is desirable to have a multi-input power supply solution.

SUMMARY

According to the embodiment of the invention, a power management system, comprises a first output stage configured to receive and regulate a first voltage; an error operational amplifier, wherein a power supply terminal of the error operational amplifier is connected to a system output port, an output terminal of the error operational amplifier is connected to an input port of the first output stage, a first input port of the error operational amplifier is configured to receive a first reference voltage, a second input port of the error operational amplifier is connected to a connection point of a first resistor and a second resistor, the first resistor is connected to an output port of the first output stage, the second resistor is connected to ground, and the system output port is located at the connection of the output port of the first output stage and the first resistor, to drive a load.

According to another embodiment of the invention, a method comprises: receiving and regulating, by a first output stage connected to the input power detector, the first voltage; comparing, by an error operational amplifier, a first reference voltage with a divided voltage, wherein a power supply terminal of the error operational amplifier is connected to a system output port, an output terminal of the error operational amplifier is connected to an output port of the first output stage, a first input port of the error operational amplifier is configured to receive the first reference voltage, a second input port of the error operational amplifier is connected to a connection point of a first resistor and a second resistor, the connection point outputs the divided voltage, the first resistor is connected to an output port of the first output stage, the second resistor is connected to ground, and a system output port is located at the connection of the output port of the first output stage and the first resistor, wherein the method further comprises operating the error operational amplifier at an system output voltage by the system output port, wherein the system output voltage is lower than the first voltage; and driving a load by the system output voltage.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

Various aspects and examples of the invention will now be described. The following description provides specific details for a thorough understanding and enabling descriptive examples. Those skilled in the art will understand, however, that the invention may be practiced without many of these details. Additionally, some well-known structures or functions may not be shown or described in detail, so as to avoid unnecessarily obscuring the relevant description.

The terminology used in the description presented below is intended to be interpreted in its broadest reasonable manner, even though it is being used in conjunction with a detailed description of certain specific examples of the invention. Certain terms may even be emphasized below, however, any terminology intended to be interpreted in any restricted manner will be overtly and specifically defined as such in this Detailed Description section.

Figure 1:
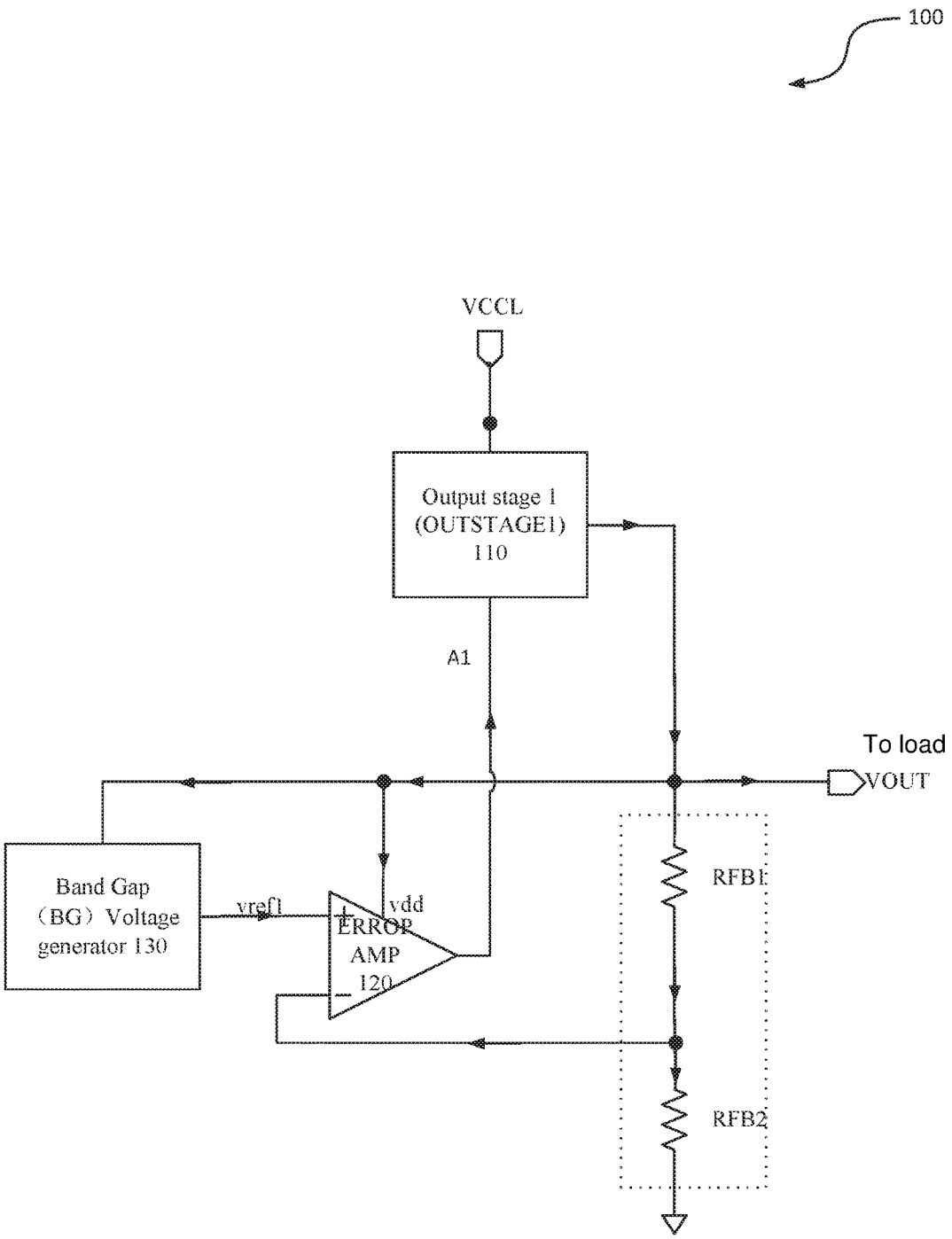
FIG. 1 is a circuit diagram for a power system according to an embodiment of the present invention.

FIG. 1 is a circuit diagram for a power system 100 according to an embodiment of the present invention. In FIG. 1, only a single power input $V_{CCL}$ is shown. Note alternatively, the single power input may include $V_{CCH}$, instead of $V_{CCL}$. $V_{CC}$ is a positive-voltage supply and normally the collector terminal of bipolar transistors is connected to the $V_{CC}$ supply or to a load which connects to $V_{CC}$. $V_{CCH}$ represents the high of $V_{CC}$. $V_{CCL}$ represents the low of $V_{CC}$.

The power management system 100 comprises a first output stage 110, and error operational amplifier (ERR OPAMP) 120. The first output stage 110 receives and regulates a first voltage ($V_{CCL}$). A power supply terminal of the error operational amplifier 120 is connected to a system output port $V_{OUT}$, an output terminal of the error operational amplifier 120 is connected to an input port of the first output stage 110. A first input port (for example, a positive input port, which is represented as +) of the error operational amplifier receives a first reference voltage vref1. A second input port (for example, a negative input port, which is represented as −) of the error operational amplifier is connected to a connection point of a first resistor $R_{FB1}$ and a second resistor $R_{FB2}$. The first resistor $R_{FB1}$ is connected to an output port of the first output stage 110. The second resistor $R_{FB2}$ is connected to ground. As such, the output port of the error operational amplifier 120, the first output stage 110, and the first resistor $R_{FB1}$ form a negative feedback loop. The system output port $V_{OUT}$ is located at the connection of the output port of the first output stage 110 and the first resistor $R_{FB1}$, to drive a load. According to FIG. 1, the positive input port and the negative input port of error operational amplifier 120 are virtually grounded, or in other words, the voltages on both the positive input port and the negative input port are the same.

Alternatively, the power management system 100 further comprises a bandgap (BG) voltage generator 130. The bandgap voltage generator 130 is connected to the error operational amplifier 120 and configured to output the first reference voltage vref1 to the first input port of the error operational amplifier 120. The reference voltage vref1 output by the bandgap voltage generator 130 is constant.

Figure 2:
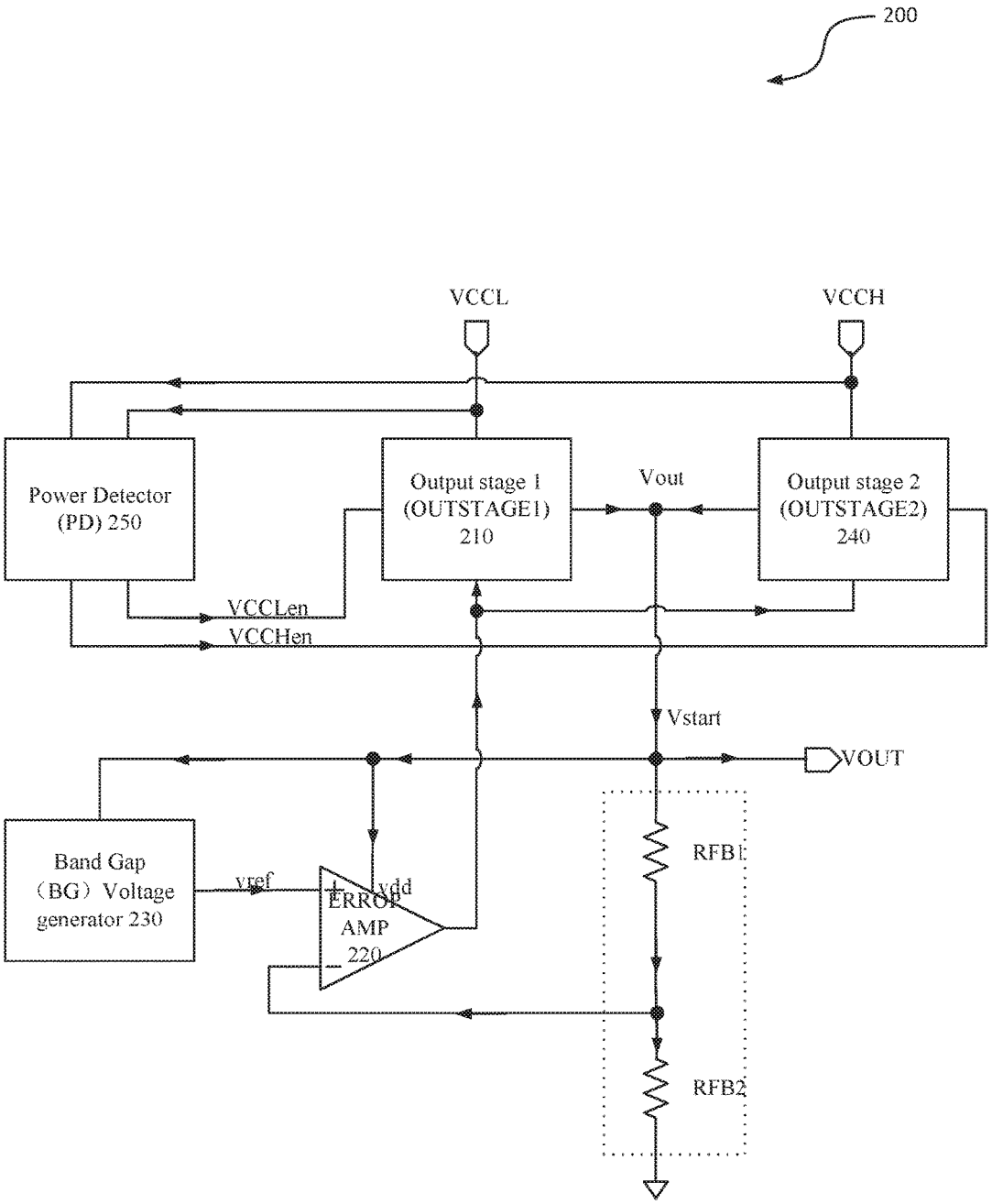
FIG. 2 is a circuit diagram for a power system according to another embodiment of the present invention.

FIG. 2 is a circuit diagram for a power system 200 according to another embodiment of the present invention.

The power management system 200 includes a first output stage 210, an error operational amplifier 220, and a band gap voltage generator 230, all respectively similar to the first output stage 110, the error operational amplifier 120, and the band gap voltage generator 130 discussed with respect to FIG. 1. The power management system 200 further comprises a second output stage 240, an input power detector 250 connected to both the first output stage 210 and the second output stage 240. The input power detector 250 generates the first enablement signal $V_{CCLen}$ or a second enablement signal $V_{CCHen}$, by detecting whether the first voltage $V_{CCL}$ or a second voltage $V_{CCH}$ is supplied. The first output stage 210 receives and regulates the first voltage $V_{CCL}$ upon receiving the first enablement signal $V_{CCLen}$. The second output stage 240 receives and regulates the second voltage $V_{CCH}$ upon receiving the second enablement signal $V_{CCHen}$. The output port of the second output stage 240 is connected to the output port of the first output stage 210. The input port of the second output stage 240 is connected to the output port of the error operational amplifier 220.

During operation, after the $V_{CCL}$ or $V_{CCH}$ is powered on, the output stage generates a voltage $V_{start}$, as illustrated in FIG. 2, $V_{start}$ voltage is less than $vref*R_{FB2}/(R_{FB1}*R_{FB2})$. The output voltage should be vref*RFB2/(RFB1+RFB2) after start up. If Vstart>vref*RFB2/(RFB1+RFB2), which means the negative feedback loop cannot work properly, the output Vout will be Vstart. Therefore vstart should be smaller than vref*RFB2/(RFB1+RFB2). The Band Gap Voltage generator 230 and the error operational amplifier 220 work under the $V_{start}$ voltage. After the band gap voltage generator 230 and the error operational amplifier 220 are stabilized, in other words, the band gap voltage reaches the target designed value, the entire feedback loop works, therefore the output voltage $V_{OUT}$ is stabilized at $vref*R_{FB2}/(R_{FB1}+R_{FB2})$.

FIG. 2 shows a circuit including two power inputs, and the circuit produces a stable $V_{OUT}$ output. Note the power detector 250, the first output stage 210, and the second output stage 240 work under $V_{CCL}$ and $V_{CCH}$. The Band Gap voltage generator 230, the error operational amplifier 220 work under voltage $V_{OUT}$.

In practice, $V_{CCL}$, $V_{CCH}$ voltage are higher than the voltage that CMOS device can withstand. For example 3V N-channel Metal Oxide Semiconductor Field Effect Transistor (NMOS FET) can bear the maximum voltage of 3.65V, while $V_{CCL}$ is up to 4.2V, and $V_{CCH}$ is up to 5.7V.

In the circuit shown in FIG. 2, only power detector 250, the first output stage 210, and the second output stage 240 work under high voltage, and the devices within these modules need to perform voltage conversion to avoid overvoltage. On the other hand, the Band Gap voltage generator 230 and the error operational amplifier 220 work under voltage $V_{OUT}$, which is below the device's maximum bearable voltage, for example, $V_{OUT}$ is lower than 3.6V, which does not need overvoltage treatment.

Figure 3A:
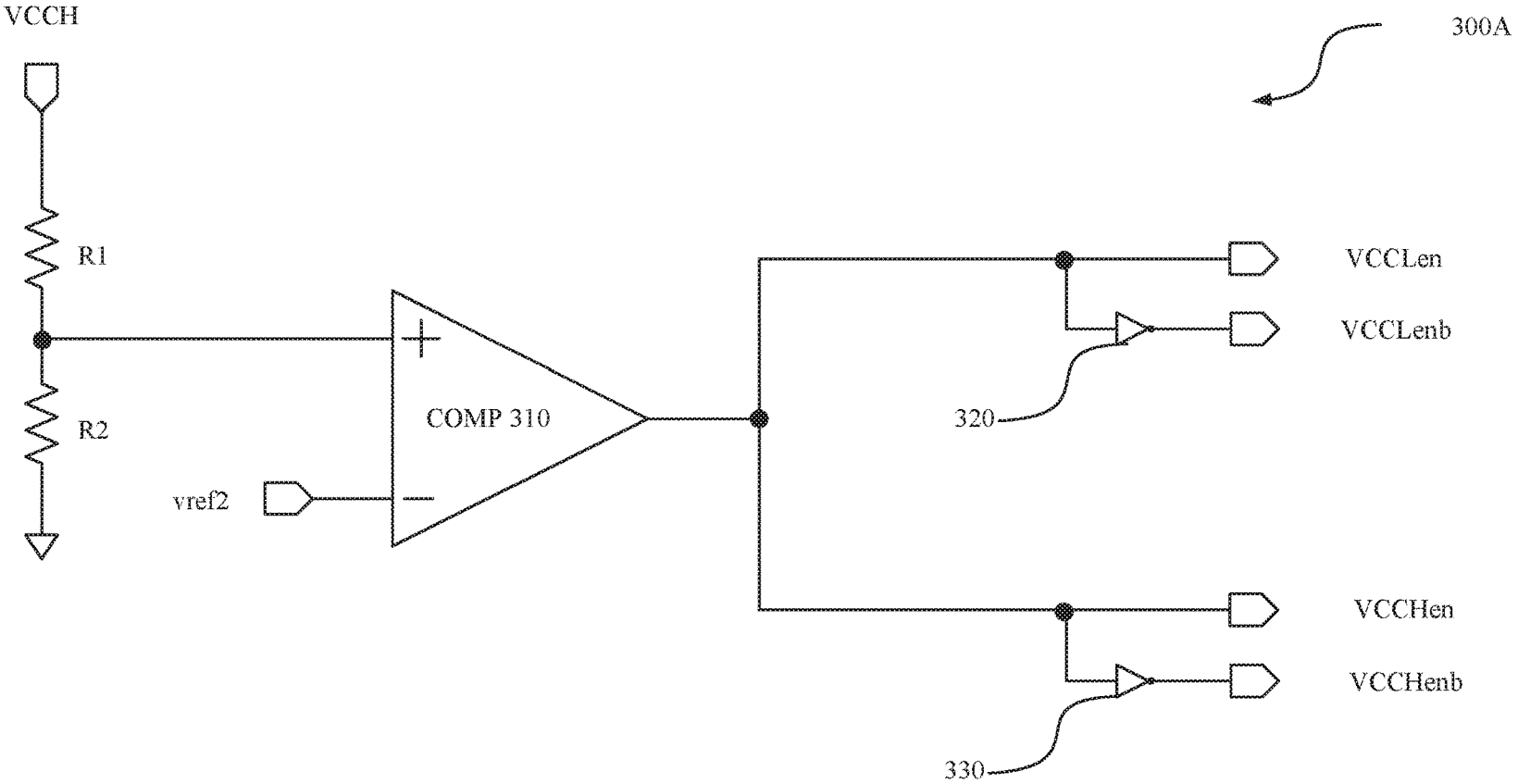
FIG. 3A is a circuit diagram illustrating an input voltage detector according to an embodiment of the invention.

FIG. 3A is a circuit diagram illustrating an input voltage detector 300A according to an embodiment of the invention. The input power detector 300A comprises a comparator 310, a first NOT gate 320 and a second NOT gate 330, a resistor R1, and a resistor R2. The resistor arrays R1 and R2 are used to detect the $V_{CCH}$. The comparator 310 determines whether an input voltage is the first voltage by comparing the input voltage with a second reference voltage vref2. The value of the second reference voltage vref2 can be set according to a relationship between the first input voltage $V_{CCL}$ and the second input voltage $V_{CCH}$. For example, vref2 can be 1.2V or other values. If the input voltage is lower than or equals the second reference voltage vref2*(R1+R2)/R2, the comparator 310 outputs the first enablement signal $V_{CCLen}$, and a second disablement signal $V_{CCHen}$ through the second NOT gate 330. If the input voltage is higher than the second reference voltage vref2, the comparator 310 outputs a second enablement signal $V_{CCHen}$, and a first disablement signal $V_{CCLenb}$ through the first NOT gate 320.

Figure 3B:
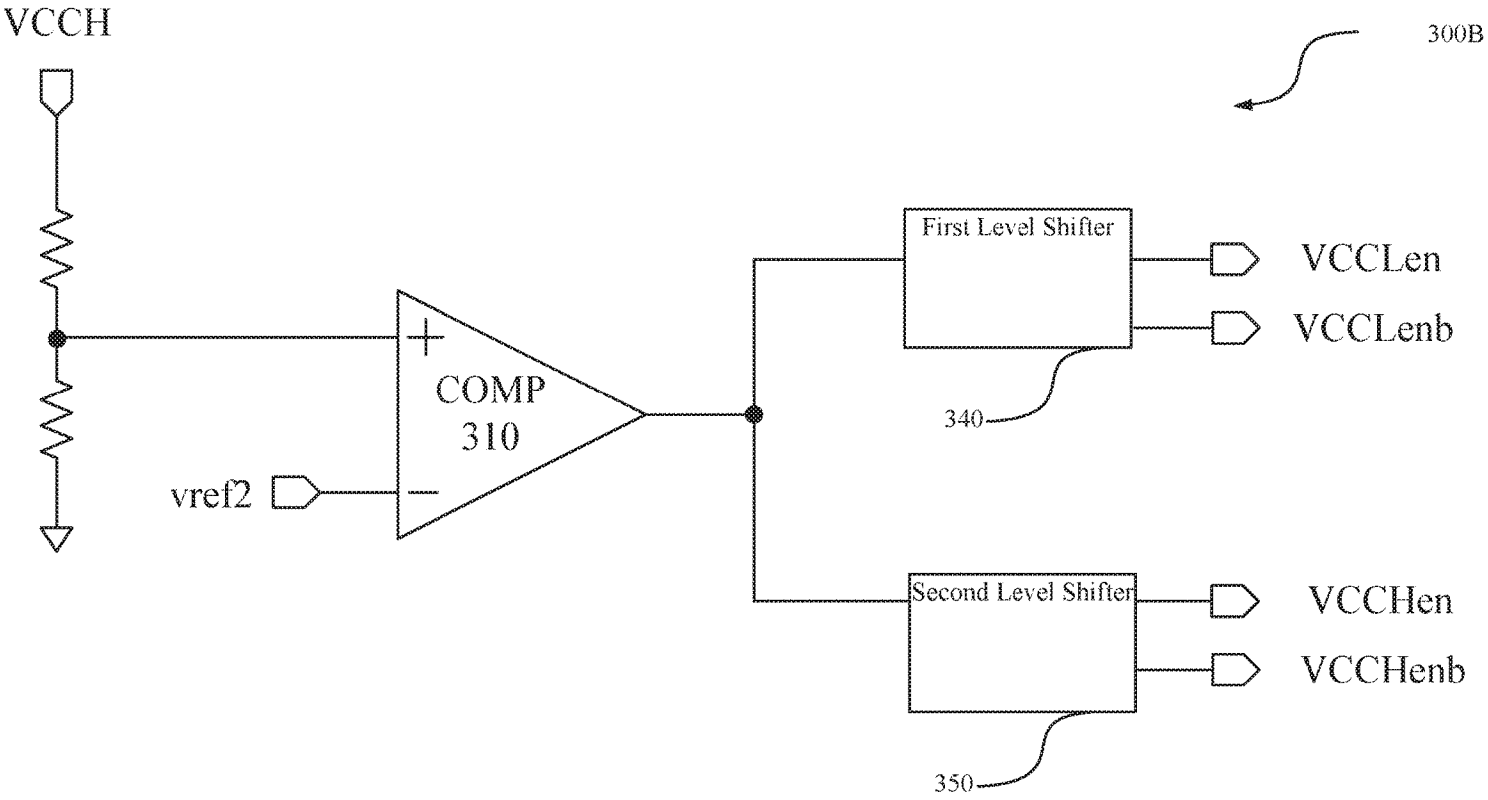
FIG. 3B is a circuit diagram illustrating an input voltage detector according to another embodiment of the invention.

FIG. 3B is a circuit diagram illustrating an input voltage detector 300B according to another embodiment of the invention. In addition to the comparator 310 already discussed with respect to FIG. 3A, the input power detector 300B further comprises a first level shifter 340 and a second level shifter 350. Both the first level shifter 340 and the second level shifter 350 are connected to the output port of the comparator 310. The first level shifter 340 is configured to output both the first enablement signal $V_{CCLen}$ and the first disablement signal $V_{CCLenb}$, and the second level shifter 350 is configured to output both the second enablement signal $V_{CCHen}$ and the second disablement signal $V_{CCHenb}$. For the range of inputs of both the first level shifter 340 and the second level shifter 350, the highest input voltage is $V_{OUT}$, and the lowest input voltage level is 0. For the range of output of the first level shifter 340, the highest output voltage is $V_{CCL}$ if $V_{CCL}$ output stage is enabled, and the lowest output voltage is the larger one between $V_{CCL}-3.6V$ and 0V (max $\{V_{CCL}-3.6, 0\}$). For the output of the second level shifter 350, a high output voltage is $V_{CCH}$ if $V_{CCH}$ output stage is enabled, and the low output voltage is the larger one between $V_{CCH}-3.6V$ and 0V (max $\{V_{CCH}-3.6, 0\}$).

Figure 4A:
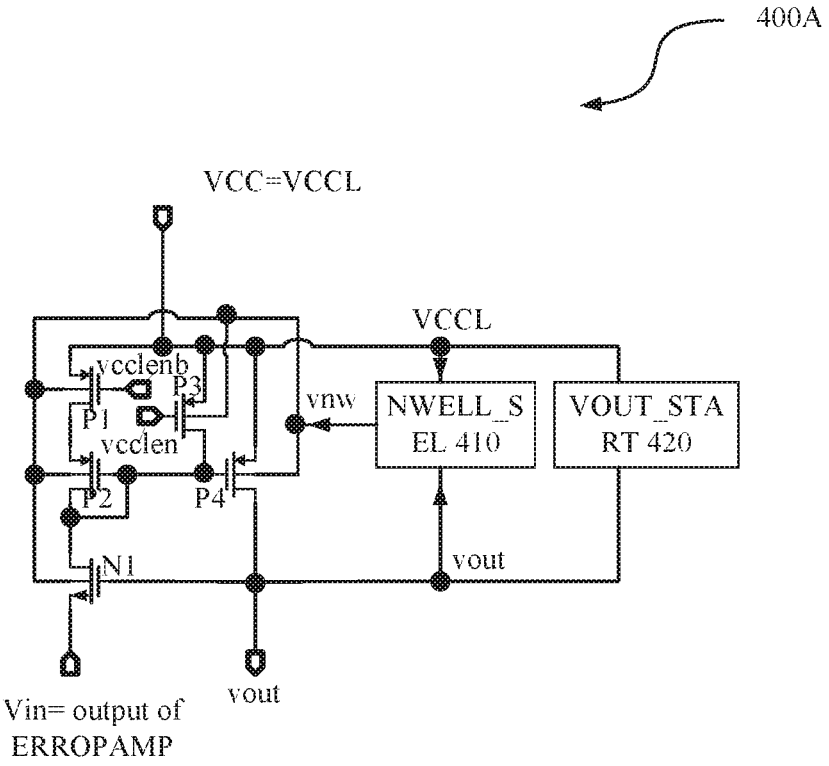
FIG. 4A is a circuit diagram illustrating the first output stage according to an embodiment of the invention.

FIG. 4A is a circuit diagram illustrating the first output stage 400A according to an embodiment of the invention. As shown in FIG. 4A, the first output stage further comprises: a first PMOS P1, a second PMOS P2, a third PMOS P3, a fourth PMOS P4, and a first NMOS N1. A source of the first NMOS N1 is configured to receive the output of the error operational amplifier 220 shown for example in FIG. 2. A drain of the first NMOS N1 is connected to all of a drain and a gate of the second PMOS P2, a gate of the fourth PMOS P4, and a drain of the third PMOS P3. A source of the second PMOS P2 is connected to a drain of the first PMOS P1. Both a source of the first PMOS P1 and a source of the third PMOS P3 are configured to receive the first voltage, and the first voltage equals either the first voltage $V_{CCL}$. A gate of the first PMOS P1 receives the first disablement signal $V_{CCLenb}$, a gate of the third PMOS P3 receives the first enablement signal $V_{CCLen}$. Bodies of the first PMOS, the second PMOS, the third PMOS and the fourth PMOS P1, P2, P3 and P4 are connected to an output port of a selector NWELL_SEL 410. A first input port of the selector NWELL_SEL 410 is connected to the first voltage $V_{CCL}$. A second input port of the selector NWELL_SEL 410 is connected to the system output port, that is, the output port the error operational amplifier 220 shown at least in FIG. 2. The detailed structure of selector NWELL_SEL 410 will be discussed with reference to FIG. 5 below. An input port of a start circuit 420 receives the first input voltage $V_{CCL}$, and an output port of the start circuit is connected to the system output port. According to the circuit shown in FIG. 4A, VOUT is protected as the voltage of VOUT will not exceed 3.6V, therefore the circuit elements will not be damaged. The selector NWELL_SEL 410 is used to generate the bias voltage for the NWELL of PMOS. The third PMOS P3 and the first PMOS P1 are used to enable the output stage. The first NMOS N1 may be removed. The second PMOS P2 and the fourth PMOS P4 are the devices of the first output stage. For example, the output stage 1 210 may comprise the second PMOS P2 and the fourth PMOS P4. If Vcclen is high, the third PMOS P3 is turned on, and the first PMOS P1 is turned off. Therefore Vout is pulled to $V_{CCL}$. The output stage is powered down. Vout may be higher than or lower than to $V_{CCL}$ By contrast, if $V_{CCLenb}$ is high, the first PMOS P1 is turned on, and the third PMOS P3 is turned off. The output stage is powered on. Therefore Vout is lower than $V_{CCL}$. The start circuit 420 is a start up block to generate initial output voltage.

Figure 4B:
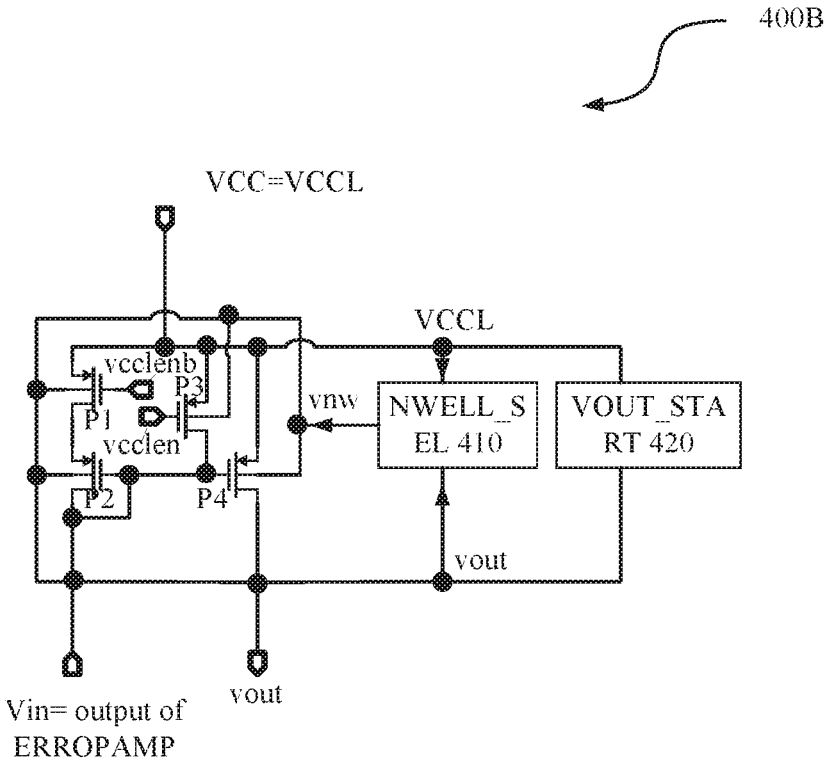
FIG. 4B is a circuit diagram illustrating the first output stage according to an embodiment of the invention.

FIG. 4B is a circuit diagram illustrating the first output stage 400B according to another embodiment of the invention. FIG. 4B is similar to FIG. 4A, except that the first NMOS N1 is removed in FIG. 4B.

Note although not shown, the second output stage comprises the same structure as the first output stage 400. The difference of the second output stage is that the first input voltage $V_{CCL}$ is replaced with the second input voltage $V_{CCH}$, and the $V_{CCLen}$ and $V_{CCLenb}$ are respectively replaced with $V_{CCHen}$ and $V_{CCHenb}$.

To be specific, the second output stage further comprises: a first PMOS P1', a second PMOS P2', a third PMOS P3', a fourth PMOS P4', and a first NMOS N1'. A source of the first NMOS N1' receives the output of the error operational amplifier. A drain of the first NMOS N1' is connected to all of a drain and a gate of the second PMOS P2', a gate of the fourth PMOS P4', and a source of the third PMOS P3'. A source of the second PMOS P2' is connected to a drain of the first PMOS P1'. Both a source of the first PMOS P1' and a drain of the third PMOS P3' receive the second voltage $V_{CCH}$. A gate of the first PMOS P1' receives the second disablement signal $V_{CCHenb}$. A gate of the third PMOS P3' receives the second enablement signal $V_{CCHen}$. Bodies of the first PMOS P1', the second PMOS P2', the third PMOS P3' and the fourth PMOS P4' are connected to an output port of a selector. A first input port of the selector is connected to the second voltage, a second input port of the selector is connected to the system output port. An input port of a start circuit is configured to receive the second input voltage, and an output port of the start circuit is connected to the system output port.

Figure 5:
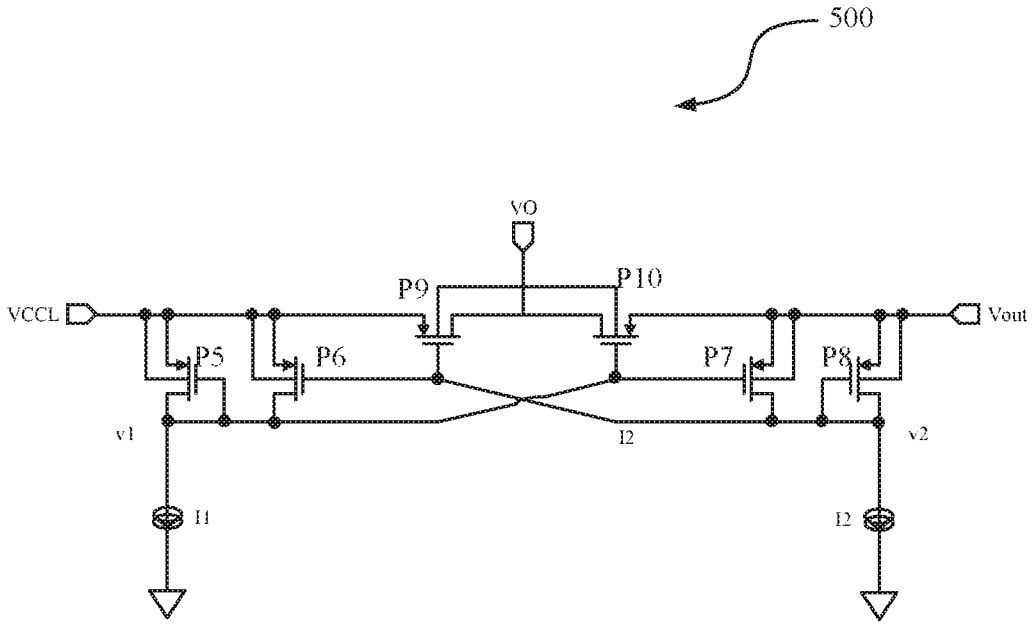
FIG. 5 is a circuit diagram illustrating a selector according to an embodiment of the invention.

FIG. 5 is a circuit diagram illustrating a selector 500 according to an embodiment of the invention. The selector 500 can be the selector NWELL_SEL 410 shown in FIG. 4A. The selector 500 further comprises a fifth PMOS P5, a sixth PMOS P6, a seventh PMOS P7, an eighth PMOS P8, a ninth PMOS P9, and a tenth PMOS P10. Sources of all the fifth PMOS P5, the sixth PMOS P6 and the ninth PMOS P9 are configured to receive the first input voltage $V_{CCL}$. Gates of the fifth PMOS P5, the seventh PMOS P7 and the tenth PMOS P10 are connected to drains of both the fifth PMOS P5 transistor and the sixth PMOS transistor P6 and a first current source I1. Sources of the seventh PMOS P7, the eighth PMOS P8 and the tenth PMOS P10 are connected to the system output port $V_{OUT}$. Gates of the eighth PMOS P8, the sixth PMOS P6 and the ninth PMOS P9 are connected to drains of both the eighth PMOS P8 and the seventh PMOS P7 and a second current source I2. A drain of the ninth PMOS P9 is connected to a drain of the tenth PMOS P10.

Although not shown in FIG. 5, the selector included in the second output stage further comprises a fifth PMOS P5', a sixth PMOS P6', a seventh PMOS P7', an eighth PMOS P8', a ninth PMOS P9', and a tenth PMOS P10'. Sources of all the fifth PMOS P5', the sixth PMOS P6' and the ninth PMOS P9' are configured to receive the second input voltage $V_{CCH}$. Gates of the fifth PMOS P5', the seventh PMOS P7' and the tenth PMOS P10' are connected to drains of both the fifth PMOS transistor P5' and the sixth PMOS transistor P6' and a first current source I1'. Sources of the seventh PMOS P7', the eighth PMOS P8' and the tenth PMOS P10' are connected to the system output port $V_{OUT}$. Gates of the eighth PMOS P8', the sixth PMOS P6' and the ninth PMOS P9' are connected to drains of both the eighth PMOS P8' and the seventh PMOS P7' and a second current source I2'. A drain of the ninth PMOS P9' is connected to a drain of the tenth PMOS P10'. This selector 500 are used to select the higher voltage from $V_{CCL}$ and vout. The output of the selector 500 Vnw will be vout if vout>$V_{CCL}$, and the vo will be $V_{CCL}$ if $V_{CCL}$>vout. Note Vnw in FIGS. 4A and 4B refers to Vo in FIG. 5.

For example $V_{CCL}$>vout, v2 will be lower than v1, P6 will power on, and v will be pulled up to $V_{CCL}$ by P6, P10 and P7 will be power down, v2 is lower than vout, v2=vout−vgs_P8, vout−v2>|vth_P9|, therefore P9 will power on, vo=$V_{CCL}$.

Alternatively, if $V_{CCL}$<vout, v2 will be higher than v1, P7 will power on, and v2 will be pulled up to Vout by P7, P9 and P6 will be power down, v1 is lower than $V_{CCL}$, v1=$V_{CCL}$−vgs_P5, $V_{CCL}$−v1>|vth_P10|, therefore P10 will power on, vo=Vout.

Figure 6:
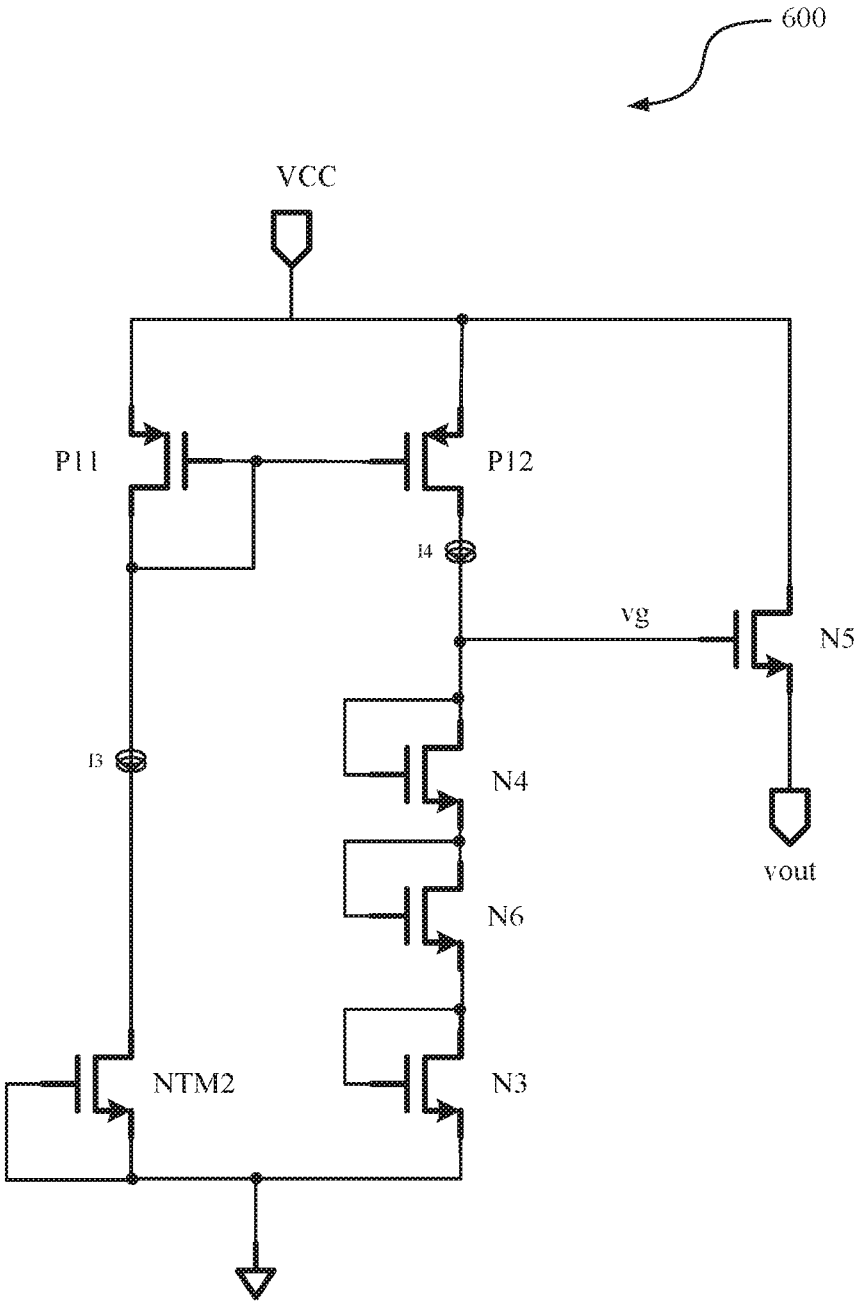
FIG. 6 is circuit diagram illustrating a start circuit according to an embodiment of the invention.

FIG. 6 is circuit diagram illustrating a start circuit 600 according to an embodiment of the invention. The start circuit 600 can be the start circuit 420 shown in FIG. 4A. The start circuit 600 further comprises an eleventh PMOS P11, a twelfth PMOS P12, a second NMOS NTM2, a third NMOS N3, a fourth NMOS N4, a fifth NMOS N5, and a sixth NMOS N6. Both gates of the eleventh PMOS P11 and the twelfth PMOS P12 are connected to a drain of the eleventh PMOS P11 and a drain of the second NMOS NTM2. The second NMOS NTM2 may be a native MOS. Native mos can be conducted when vgs=0V, whereas normal NMOS will be conducted when vgs>vth (vth is about 0.7 v, the vth will be different for different process, but vth>0. Sources of both the eleventh PMOS P11 and the twelfth PMOS P12, and a drain of the fifth NMOS N5 are configured to receive the first voltage $V_{CCLen}$. Drain of the twelfth PMOS P12 is connected to a gate of the fifth NMOS N5. A drain and a gate of the fourth NMOS N4 are connected to the gate of the fifth NMOS N5. A source of the fourth NMOS N4 is connected to both a drain and a gate of the sixth NMOS N6. A source of the sixth NMOS N6 is connected to both a drain and a gate of the third NMOS N3. The start circuit 600 is used to generate initial voltage. The second NMOS NTM2 generates bias current I3, I4 is the mirror currents of I3, I4 is injected in N4,N6,N3 to generate voltage vg, vout=vg−vgs_N5. I3 and I4 may be current sources.

A voltage larger than 1.8V is generated for generating the initial voltage VOUT. As some modules (Band Gap voltage generator, the error operational amplifier) work under the voltage $V_{OUT}$, if there is no initial voltage $V_{OUT}$ upon power on, the Band Gap voltage generator and the error operational amplifier will not work normally, resulting in the whole system's failure to operate. Although FIG. 6 show three cascaded NMOS transistors N4, N6 and N3, the number of diode-connected NMOS transistors and the current flowing through the NMOS are related to IC process, and can be determined based on simulations.

Although not shown in FIG. 6, the start circuit in the second output stage further comprises an eleventh PMOS P11', a twelfth PMOS P12', a second NMOS NTM2', a third NMOS N3', a fourth NMOS N4', a fifth NMOS N5', and a sixth NMOS N6'. Both gates of the eleventh PMOS P11' and the twelfth PMOS P12' are connected to a drain of the eleventh PMOS P11' and a drain of the second NMOS NTM2'. Sources of both the eleventh PMOS P11' and the twelfth PMOS P12', and a drain of the fifth NMOS N5' receive the second voltage $V_{CCH}$. Drain of the twelfth PMOS P12' is connected to a gate of the fifth NMOS N5'. A drain and a gate of the fourth NMOS N4' are connected to a gate of the fifth NMOS N5'. A source of the fourth NMOS N4' is connected to both a drain and a gate of the sixth NMOS N6'. A source of the sixth NMOS N6' is connected to both a drain and a gate of the third NMOS N3'.

Figure 7:
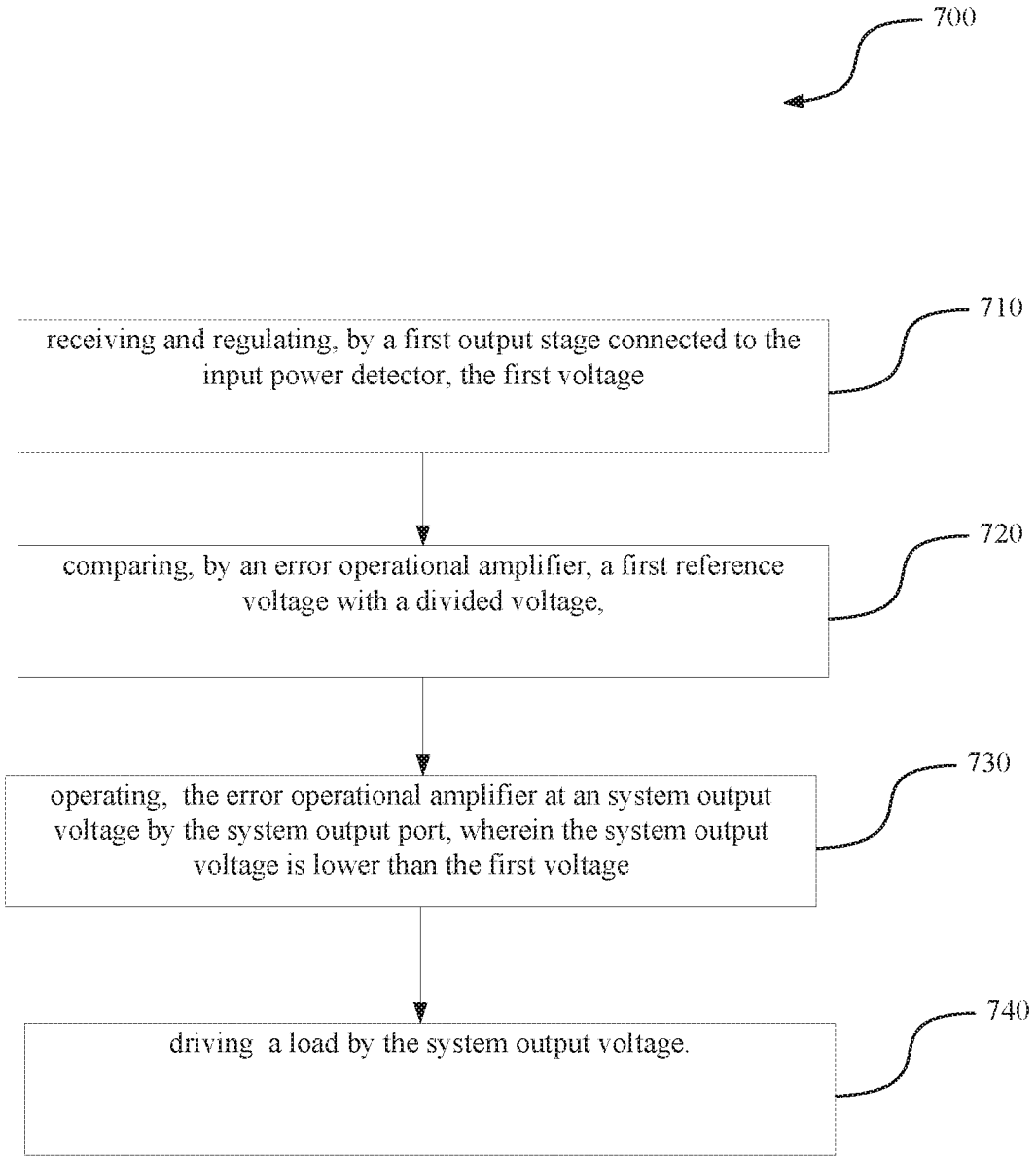
FIG. 7 is a flow chart illustrating a method for power management according to an embodiment of the invention.

FIG. 7 is a flow chart illustrating a method 700 for power management according to an embodiment of the invention.

The method 700 for power management comprises: receiving and regulating, by a first output stage connected to the input power detector in block 710, the first voltage; comparing, by an error operational amplifier in block 720, a first reference voltage with a divided voltage, wherein a power supply terminal of the error operational amplifier is connected to a system output port, an output terminal of the error operational amplifier is connected to an input port of the first output stage, a first input port of the error operational amplifier is configured to receive the first reference voltage, a second input port of the error operational amplifier is connected to a connection point of a first resistor and a second resistor, the connection point outputs the divided voltage, the first resistor is connected to an output port of the first output stage, the second resistor is connected to ground, and a system output port is located at the connection of the output port of the first output stage and the first resistor. The method 700 further comprises operating, in block 730, the error operational amplifier at an system output voltage by the system output port, wherein the system output voltage is lower than the first voltage; and driving, in block 740, a load by the system output voltage.

Alternatively, the power management system further comprises a bandgap voltage generator, wherein the bandgap voltage generator is connected to the error operational amplifier and configured to output the first reference voltage to the first input port of the error operational amplifier.

Alternatively, the power management system further comprises a second output stage, an input power detector connected to both the first output stage and the second output stage, wherein the method 700 further comprises (not shown in FIG. 7), generating, by the input power detector, the first enablement signal or a second enablement signal by detecting whether the first voltage or a second voltage is supplied; receiving and regulating, by the first output stage, the first voltage upon receiving the first enablement signal; receiving and regulating, by the second output stage, the second voltage upon receiving the second enablement signal; wherein the output port of the second output stage is connected to the output port of the first output stage; the input port of the second output stage is connected to the output port of the error operational amplifier.

Alternatively, the method 700 further comprises (not shown in FIG. 7), determining, by a comparator, whether an input voltage is the first voltage by comparing the input voltage with a second reference voltage; outputting, by the comparator, the first enablement signal and a second disablement signal if the input voltage is lower than or equals the second reference voltage; outputting, by the comparator, a second enablement signal and a first disablement signal if the input voltage is higher than the second reference voltage.

Figure 8:
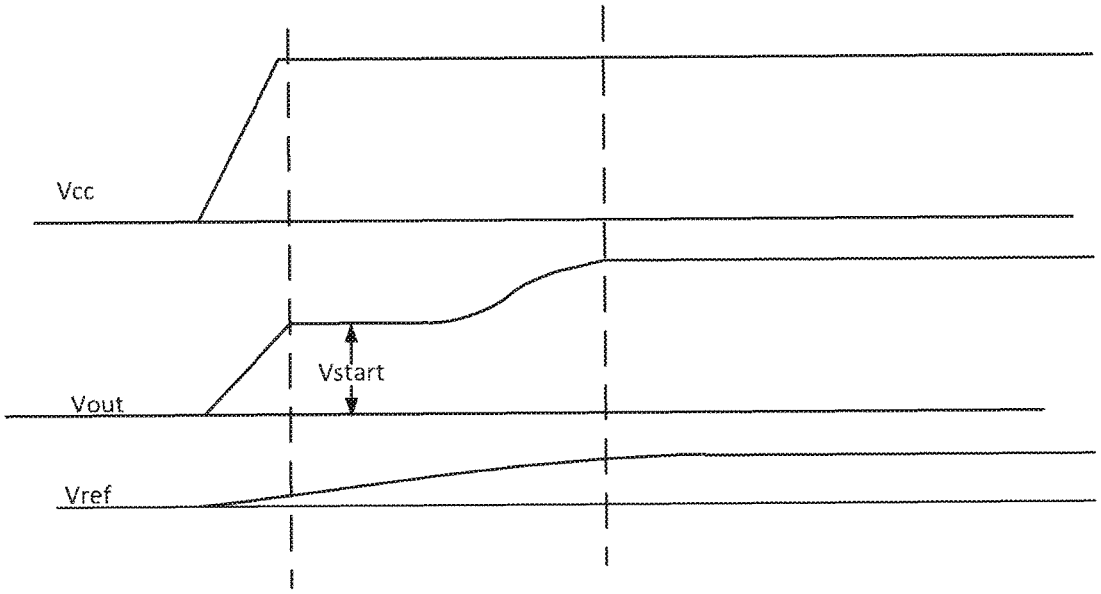
FIG. 8 is a diagram illustrating the waveform of input and output voltage signals.

FIG. 8 is a diagram illustrating the waveform of input and output voltage signals. As shown in FIG. 8, the Vout first reaches Vstart, and then stabilized at $V_{OUT}$. Note $V_{CC}$ will be $V_{CCL}$ if there is not $V_{CCH}$, otherwise $V_{CC}$ will be $V_{CCH}$.

From the foregoing, it will be appreciated that specific embodiments of the technology have been described herein for purposes of illustration, however various modifications can be made without deviating from the spirit and scope of the present invention. Accordingly, the present invention is not restricted except in the spirit of the appended claims.

Other variations to the disclosed embodiments can be understood and effected by those skilled in the art in practicing the claimed invention, from a study of the drawings, the disclosure, and the appended claims. In the claims the word "comprising" does not exclude other elements or steps, and the indefinite article "a" or "an" does not exclude a plurality. Even if particular features are recited in different dependent claims, the present invention also relates to the embodiments including all these features. Any reference signs in the claims should not be construed as limiting the scope.

Features and aspects of various embodiments may be integrated into other embodiments, and embodiments illustrated in this document may be implemented without all of the features or aspects illustrated or described. One skilled in the art will appreciate that although specific examples and embodiments of the system and methods have been described for purposes of illustration, various modifications can be made without deviating from the spirit and scope of the present invention. Moreover, features of one embodiment may be incorporated into other embodiments, even where those features are not described together in a single embodiment within the present document. Accordingly, the invention is described by the appended claims.

What is claimed is:

1. A power management system, comprising:

a first output stage configured to receive and regulate a first voltage;

an error operational amplifier, wherein a power supply terminal of the error operational amplifier is connected to a system output port, an output terminal of the error operational amplifier is connected to an input port of the first output stage, a first input port of the error operational amplifier is configured to receive a first reference voltage, a second input port of the error operational amplifier is connected to a connection point of a first resistor and a second resistor, the first resistor is connected to an output port of the first output stage, the second resistor is connected to ground, and the system output port is located at the connection of the output port of the first output stage and the first resistor, to drive a load;

wherein the power management system further comprises a second output stage, an input power detector connected to both the first output stage and the second output stage, wherein the input power detector is configured to generate a first enablement signal or a second enablement signal by detecting whether the first voltage or a second voltage is supplied;

the first output stage is configured to receive and regulate the first voltage upon receiving the first enablement signal;

the second output stage is configured to receive and regulate the second voltage upon receiving the second enablement signal;

the output port of the second output stage is connected to an output port of the first output stage;

the input port of the second output stage is connected to the output terminal of the error operational amplifier.

2. The power management system of claim 1, further comprising a bandgap voltage generator, wherein the bandgap voltage generator is connected to the error operational amplifier and configured to output the first reference voltage to the first input port of the error operational amplifier.

3. The power management system of claim 1, wherein the input power detector further comprises:

a comparator configured to determine whether an input voltage is the first voltage by comparing the input voltage with a second reference voltage;

if the input voltage is lower than or equals the second reference voltage, the comparator is configured to output the first enablement signal and a second disablement signal;

if the input voltage is higher than the second reference voltage, the comparator is configured to output a second enablement signal and a first disablement signal.

4. The power management system of claim 3, wherein the input power detector further comprises a first level shifter and a second level shifter, wherein both the first level shifter and the second level shifter are connected to an output port of the comparator, the first level shifter is configured to output both the first enablement signal and the first disablement signal, and the second level shifter is configured to output both the second enablement signal and the second disablement signal.

5. The power management system of claim 1, wherein the first output stage further comprises: a first PMOS, a second PMOS, a third PMOS, a fourth PMOS, a first NMOS, wherein a source of the first NMOS is configured to receive the output terminal of the error operational amplifier, a drain of the first NMOS is connected to all of a drain and a gate of the second PMOS, a gate of the fourth PMOS, and a drain of the third PMOS, a source of the second PMOS is connected to a drain of the first PMOS, both a source of the first PMOS and a source of the third PMOS are configured to receive the first voltage, a gate of the first PMOS is configured to receive a first disablement signal, a gate of the third PMOS is configured to receive the first enablement signal, wherein bodies of the first PMOS, the second PMOS, the third PMOS and the fourth PMOS are connected to an output port of a selector, a first input port of the selector is connected to the first voltage, a second input port of the selector is connected to the system output port;

wherein an input port of a start circuit is configured to receive the first input voltage, and an output port of the start circuit is connected to the system output port.

6. The power management system of claim 5, wherein the selector further comprises a fifth PMOS, a sixth PMOS, a seventh PMOS, an eighth PMOS, a ninth PMOS, a tenth PMOS, wherein sources of all the fifth PMOS, the sixth PMOS and the ninth PMOS are configured to receive the first input voltage, gates of the fifth PMOS, the seventh PMOS and the tenth PMOS are connected to a drain of the fifth PMOS transistor and a first current source, sources of the seventh PMOS, the eighth PMOS and the tenth PMOS are connected to the system output port, gates of the eighth PMOS, sixth PMOS and ninth PMOS are connected to a drain of the eighth PMOS and a second current source, a drain of the ninth PMOS is connected to a drain of the tenth PMOS.

7. The power management system of claim 5, wherein the start circuit further comprises an eleventh PMOS, a twelfth PMOS, a second NMOS, a third NMOS, a fourth NMOS, a fifth NMOS, and a sixth NMOS, wherein both gates of the eleventh PMOS and the twelfth PMOS are connected to a drain of the eleventh PMOS and a drain of the second NMOS, sources of both the eleventh PMOS and the twelfth PMOS, and a drain of the fifth NMOS are configured to receive the first voltage, drain of the twelfth PMOS is connected to a gate of the fifth NMOS, a drain and a gate of the fourth NMOS, a source of the fourth NMOS is connected to both a drain and a gate of the sixth NMOS, and a source of the sixth NMOS is connected to both a drain and a gate of the third NMOS.

8. The power management system of claim 1, wherein the second output stage further comprises: a first PMOS, a second PMOS, a third PMOS, a fourth PMOS, a first NMOS, wherein a source of the first NMOS is configured to receive the output of the error operational amplifier, a drain of the first NMOS is connected to all of a drain and a gate of the second PMOS, a gate of the fourth PMOS, and a source of the third PMOS, a source of the second PMOS is connected to a drain of the first PMOS, both a source of the first PMOS and a drain of the third PMOS are configured to receive the second voltage, a gate of the first PMOS is configured to receive the second enablement signal, a gate of the third PMOS is configured to receive the second disablement signal, wherein bodies of the first PMOS, the second PMOS, the third PMOS and the fourth PMOS are connected to an output port of a selector, a first input port of the selector is connected to the first voltage, a second input port of the selector is connected to the system output port;

wherein an input port of a start circuit is configured to receive the second input voltage, and an output port of the start circuit is connected to the system output port.

9. The power management system of claim 8, wherein the selector further comprises a fifth PMOS, a sixth PMOS, a seventh PMOS, an eighth PMOS, a ninth PMOS, a tenth PMOS, wherein sources of all the fifth PMOS, the sixth PMOS and the ninth PMOS are configured to receive the first input voltage, gates of both the fifth PMOS and the seventh PMOS are connected to drains of both the fifth PMOS transistor and the sixth PMOS transistor and a first current source, sources of the seventh PMOS, the eighth PMOS and the tenth PMOS are connected to the system output port, both gates of the eighth PMOS and sixth PMOS are connected to drains of both the eighth PMOS and the seventh PMOS and a second current source, a drain of the ninth PMOS is connected to a drain of the tenth PMOS.

10. The power management system of claim 8, wherein the start circuit further comprises an eleventh PMOS, a twelfth PMOS, a second NMOS, a third NMOS, a fourth NMOS, a fifth NMOS, and a sixth NMOS, wherein both gates of the eleventh PMOS and the twelfth PMOS are connected to a drain of the eleventh PMOS and a drain of the second NMOS, sources of both the eleventh PMOS and the twelfth PMOS, and a drain of the fifth NMOS are configured to receive the second voltage, drain of the twelfth PMOS is connected to a gate of the fifth NMOS, a drain and a gate of the fourth NMOS are connected to the gate of the fifth NMOS, a source of the fourth NMOS is connected to both a drain and a gate of the sixth NMOS, and a source of the sixth NMOS is connected to both a drain and a gate of the third NMOS.

11. A method for power management in a power management system, comprising:

receiving and regulating, by a first output stage connected to an input power detector, a first voltage;

comparing, by an error operational amplifier, a first reference voltage with a divided voltage, wherein a power supply terminal of the error operational amplifier is connected to a system output port, an output terminal of the error operational amplifier is connected to an input of the first output stage, a first input port of the error operational amplifier is configured to receive the first reference voltage, a second input port of the error operational amplifier is connected to a connection point of a first resistor and a second resistor, the connection point outputs the divided voltage, the first resistor is connected to an output port of the first output stage, the second resistor is connected to ground, and a system output port is located at the connection of the output port of the first output stage and the first resistor, wherein the method further comprises operating the error operational amplifier at a system output voltage by the system output port, wherein the system output voltage is lower than the first voltage; and driving a load by the system output voltages;

wherein the power management system further comprises a second output stage, an input power detector connected to both the first output stage and the second output stage, wherein the method further comprises:

generating, by the input power detector, a first enablement signal or a second enablement signal by detecting whether the first voltage or a second voltage is supplied;

receiving and regulating, by the first output stage, the first voltage upon receiving the first enablement signal;

receiving and regulating, by the second output stage, the second voltage upon receiving the second enablement signal; wherein an output port of the second output stage is connected to an output port of the first output stage;

the input port of the second output stage is connected to the output terminal of the error operational amplifier.

12. The method of claim 11, wherein the power management system further comprises a bandgap voltage generator, wherein the bandgap voltage generator is connected to the error operational amplifier and configured to output the first reference voltage to the first input port of the error operational amplifier.

13. The method of claim 11, further comprising determining, by a comparator, whether an input voltage is the first voltage by comparing the input voltage with a second reference voltage;

outputting, by the comparator, the first enablement signal and a second disablement signal if the input voltage is lower than or equals the second reference voltage;

outputting, by the comparator, a second enablement signal and a first disablement signal if the input voltage is higher than the second reference voltage.

* * * * *